United States Patent [19]

Tillman

[11] Patent Number: 4,911,508

[45] Date of Patent: Mar. 27, 1990

[54] CABINET WITH FOOT PEDAL-OPERATED DOOR OPENER

[75] Inventor: Harry L. Tillman, Knight Township, Vanderburgh County, Ind.

[73] Assignee: Whirlpool Corporation, Benton Harbor, Mich.

[21] Appl. No.: 236,197

[22] Filed: Aug. 25, 1988

[51] Int. Cl.[4] ..... E05F 11/00

[52] U.S. Cl. ..... 312/319; 49/278; 292/255

[58] Field of Search ..... 312/139, 319, 320, 330 R; 292/255; 49/276, 277, 278; 16/DIG. 7

[56] References Cited

U.S. PATENT DOCUMENTS

| | | | |
|---|---|---|---|
| 678,407 | 7/1901 | Lee | 49/278 X |
| 762,729 | 6/1904 | Lee | 49/278 X |
| 885,570 | 4/1908 | Bergquist . | |
| 1,244,910 | 10/1917 | Smith . | |
| 1,611,386 | 12/1926 | Stanley . | |
| 1,676,164 | 7/1928 | Schlaegel . | |
| 2,124,349 | 7/1938 | Herbster . | |
| 2,210,229 | 8/1940 | Boerner . | |
| 2,348,955 | 5/1944 | Buchanan . | |
| 2,634,970 | 4/1953 | Rogebrook . | |
| 2,689,776 | 9/1954 | Cline . | |
| 3,007,695 | 11/1961 | Bell, Jr. | 49/278 X |
| 3,012,837 | 12/1961 | Morrissey, Jr. . | |
| 3,030,102 | 4/1962 | Smith | 292/255 X |
| 3,364,621 | 1/1968 | Erickson . | |
| 3,520,568 | 7/1970 | White et al. . | |

FOREIGN PATENT DOCUMENTS

| | | | |
|---|---|---|---|
| 662601 | 5/1963 | Canada | 312/319 |
| 665538 | 5/1988 | Switzerland | 312/330 R |

*Primary Examiner*—Joseph Falk

*Attorney, Agent, or Firm*—Wood, Dalton, Phillips, Mason & Rowe

[57] ABSTRACT

A cabinet structure having an improved user-mountable foot pedal-operated door opener. The pivot rod of the door opener may be mounted by the user to brackets previously mounted to the cabinet by the manufacturer, permitting completed installation of the door opener by the user without the need for tools. In one form, the door opener acts against a slide plate carried on the lower edge portion of the door of the cabinet, and in another form, a roller is provided on the pivot rod for directly engaging the door lower edge portion. The pivot rod may be readily removed from the cabinet construction, when desired, such as during subsequent shipment of the cabinet structure.

18 Claims, 1 Drawing Sheet

FIG. 1
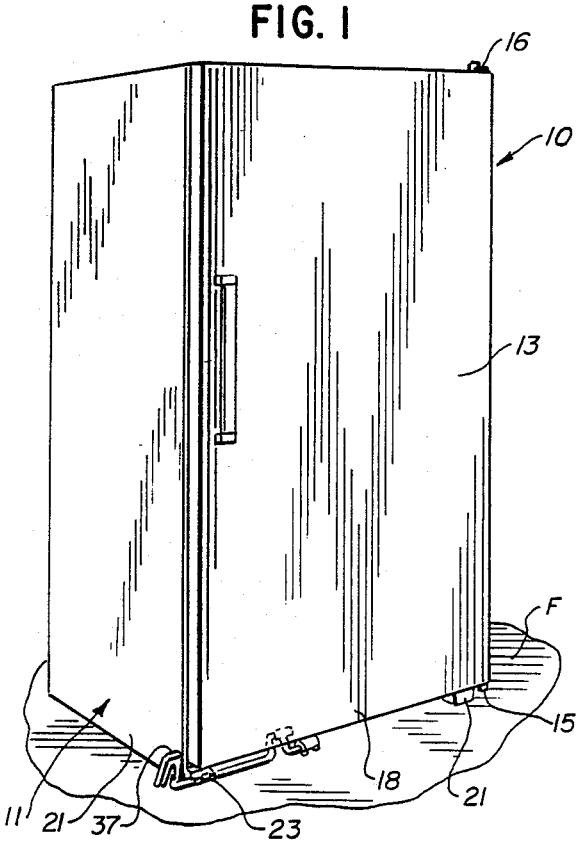
FIG. 2
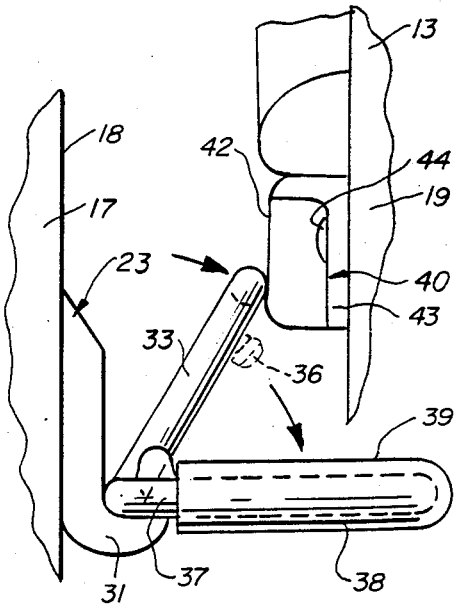
FIG. 3
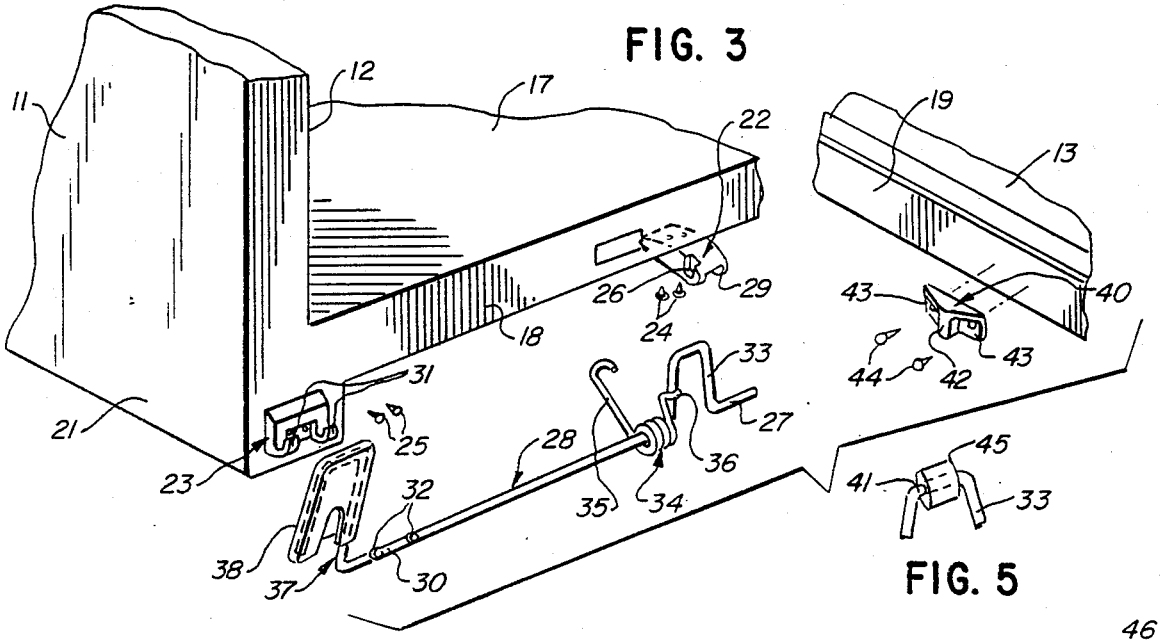
FIG. 5
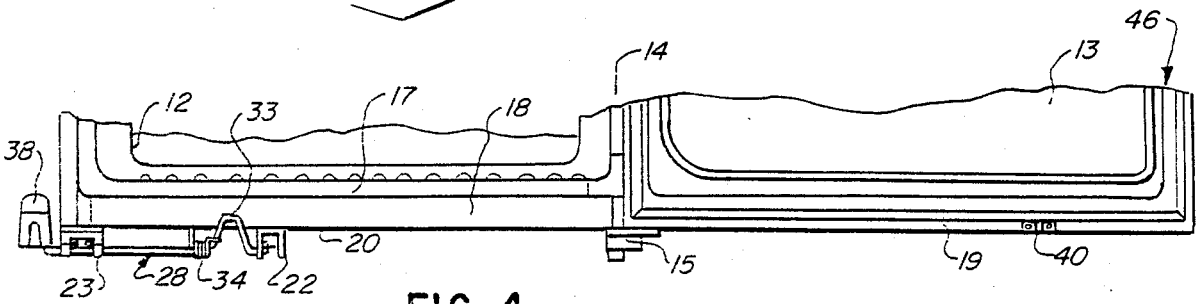
FIG. 4

CABINET WITH FOOT PEDAL-OPERATED DOOR OPENER

TECHNICAL FIELD

This invention relates to cabinet structures and in particular to means for effecting opening of the door of a cabinet, such as a refrigerator cabinet, by means of a user's foot.

BACKGROUND ART

In one conventional form of refrigeration apparatus, the cabinet defines a refrigeration cavity having a front opening which is selectively closed by a vertical door. The door is hingedly mounted to the cabinet along one edge and is provided with a handle at the opposite edge for grasping by the user in moving the door between closed and open positions.

At times, the user's hands may be unavailable for grasping of the handle, such as when carrying objects intended to be placed in the cabinet.

A number of foot-operated door opening devices have been developed intended to permit the user to effect the opening of the cabinet door by application of the user's foot to a pedal portion of the device. None of the prior food pedal-operated door openers, however, have been completely satisfactory.

DISCLOSURE OF INVENTION

The present invention comprehends an improved cabinet structure having a foot pedal-operated door opener which is extremely simple and economical of construction, while yet providing facilitated installation and use.

More specifically, the invention comprehends the provision of such a cabinet structure wherein portions of the door opener are mounted to the cabinet prior to installation of the remaining door opener structure by the user.

The invention comprehends such a door opener structure adapted to be readily mounted to the cabinet structure by the user without the need for installation tools.

In the illustrated embodiment, the cabinet structure includes wall means at one side of the cavity for selectively closing the cavity, the wall means having a bottom wall defining a front edge portion and the door defining a lower edge portion juxtaposed to the bottom wall in a closed position of the door extending across the cavity. The foot operable door opener is mounted to the wall means at the bottom wall and at a second side of the cavity opposite the one side. In the illustrated embodiment, the door opener includes a pivot rod defining a longitudinal axis and having a first end, a laterally projecting presser portion, an opposite, laterally projecting second end portion, and laterally projecting retaining means at a position intermediate the end portions, a first pivot bracket mounted to said wall means and defining a socket rotatively receiving the first end of the pivot rod for rotation of the pivot rod about its longitudinal axis, a second pivot bracket mounted to the wall means and defining a side opening trunnion for pivotally supporting a portion of the pivot rod inserted laterally thereinto, means on the wall means for cooperating with the retaining means of the pivot rod for retaining the pivot rod with the first end pivotally associated with the first pivot bracket and the opposite, second end portion outwardly of the wall means at the second side of the cavity, the presser portion being disposed inwardly of the lower edge portion of the door and swingable outwardly thereagainst as an incident of displacement of the opposite end portion of the pivot rod about the longitudinal axis of the pivot rod, thereby to swing the door outwardly away from the closed position, and means for biasing the pivot rod to urge the presser portion inwardly away from the door.

A pad may be removably mounted to the end portion of the rod for engagement by the user's foot.

In the illustrated embodiment, the biasing means comprises spring means acting between the wall means and the presser portion of the pivot rod.

In the illustrated embodiment, the bottom wall of the cabinet defines a bottom surface, and the first pivot bracket is mounted thereto. The bottom wall further defines a front surface, and the second pivot bracket is mounted thereto.

In the illustrated embodiment, the presser portion of the pivot rod comprises a U-shaped portion thereof.

The opposite end portion of the pivot rod, in the illustrated embodiment, comprises a U-shaped portion thereof.

Retaining means may be provided comprising a pair of retaining elements spaced apart longitudinally of the pivot rod to be disposed one each at opposite sides of the means on the wall means for cooperating with the retaining means.

In one form of the invention, a roller is mounted to the presser portion to have rolling engagement with the door lower edge portion in effecting the foot-operated opening thereof.

The door opener may include a slide plate mounted on the door lower edge portion.

In the illustrated embodiment, the slide plate defines a vertical elongate slide surface to be engaged by the presser portion of the rod. In the closed position of the door, the presser portion is disposed adjacent the slide surface whereby the opening of the door may be effected with minimum movement of the foot-operated end of the pivot rod.

The slide plate may include side flanges and means for removably securing the side flanges to the door lower edge portion.

The slide plate is formed of a material having a low surface friction characteristic, such as a synthetic resin.

The invention further comprehends the improved method of mounting a foot pedal-operated door opener to a cabinet structure including the steps of providing the cabinet structure with a first pivot rod support bracket and a second pivot rod support bracket. The cabinet structure is then caused to be transported to a use site, with the pivot brackets so mounted. A pivot rod is then installed in association with the pivot brackets by the user at the use site.

The installation of the door opener structure by the user may be effected without the use of tools, thus permitting shipment of the cabinet structure free of the associated door opener structure other than the mounting brackets thereof, while yet permitting facilitated provision of the complete door opener structure by the user of the cabinet structure in a novel and simple manner.

The door opener structure of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus cabinet structure having a foot pedal-operated door opener embodying the invention;

FIG. 2 is a fragmentary enlarged side elevation illustrating the operation of the door opener in effecting an opening of the cabinet door;

FIG. 3 is a fragmentary exploded perspective view illustrating the mounting of the components of the door opener of the invention;

FIG. 4 is a fragmentary front elevation illustrating the mounting of the door opener on the bottom wall of the cabinet structure, and the mounting of a slide plate for cooperation therewith on the lower edge portion of the closure door; and FIG. 5 is a fragmentary perspective view illustrating a modified form of door opener having roller means provided on the presser portion of the pivot rod.

BEST MODE FOR CARRYING OUT THE INVENTION

In the illustrative embodiment of the invention as shown in FIGS. 1–4 of the drawing, a cabinet structure generally designated 10 is shown to comprise a refrigeration apparatus cabinet structure including walls 11 defining a front opening refrigeration space 12 adapted to be selectively closed by a door 13 hingedly mounted to one sidewall 14 by a pair of hinges 15 and 16.

Cabinet 10 further defines a bottom wall 17 having a front surface 18 disposed inwardly of a lower edge portion 19 of door 13, when the door is in the closed position of FIG. 1. Bottom wall 17 further defines a bottom surface 20 which is spaced above the supporting floor surface F by a plurality of lower edge portions 21 of the sidewalls of the cabinet. Front surface 18 extends laterally to the opposite sides of the cabinet, as seen in FIG. 3.

As indicated above, the invention comprehends the provision, in such a cabinet structure, of improved means for effecting opening of the door 13 from the closed position of FIG. 1 by use of a person's foot so as to permit the user to effectively open the door while having his or her hands otherwise occupied. The invention comprehends providing, on the cabinet walls prior to delivery of the cabinet structure to the use site, a pair of pivot rod support, or mounting, brackets, including mounting bracket 22 and mounting bracket 23, as best seen in FIG. 3. Mounting bracket 22 is mounted to the bottom surface 20 of bottom wall 17, such as by screws 24. Bracket 23 is mounted to the front surface 18 of the bottom wall at the lower end 21 of the sidewall, as by screws 25. Thus, as seen in FIG. 1, bracket 23 is disposed adjacent the lower edge of the door 13 when the door is in the closed position.

Bracket 22 defines a first pivot bracket having a side opening 26 defining a socket for rotatively receiving a first end 27 of a pivot rod generally designated 28. The bracket 22 further includes an outer depending wall 29 for limiting the movement of rod end 27 to the right through opening 26, as seen in FIG. 3.

Pivot rod 28 further defines a left end portion 30 adapted to be pivotally received in a pair of upturned U-shaped flanges 31 on pivot bracket 23. Flanges 31 may extend slightly beyond 180 degrees so as to permit facilitated insertion of the rod portion 30 thereinto, while yet effectively retaining the rod portion from accidental displacement therefrom.

Rod portion 30 is further provided with a pair of bosses 32, which may comprise spherical bosses, spaced apart a preselected distance so as to be fitted between the bracket flanges 31 and thereby prevent axial movement of the rod 28 on the brackets 22 and 23 when end 27 is received in bracket 22 and end portion 30 is received in the pivot flanges 31 of bracket 23.

As further illustrated in FIG. 3, rod 28 includes a U-shaped presser portion 33 adjacent end 27, which is captured between front surface 18 of bottom wall 17 and lower edge portion 19 of door 13 when the door is in the closed position. Presser portion 33 is urged toward bottom wall surface 18 by suitable biasing means, such as coil spring 34, having one end 35 engaging the bottom surface 20 of bottom wall 17, and an opposite end 36 embracing the presser portion 33 so as to bias the presser portion toward the bottom wall surface 18, as seen in FIG. 3.

The leftwardmost distal end portion generally designated 37 of rod 28 comprises a U-shaped portion defining the foot pedal portion of the rod adapted to be engaged by a user's foot in effecting the desired opening of door 13. A cap 38 is fitted on the U-shaped end portion 37 for facilitated engagement by the user's foot.

As seen in FIGS. 1 and 3, the foot pedal portion 37 extends at a small upright angle forwardly so as to permit the user to bring his or her foot downwardly on the upper surface 39 of cap 38 so as to pivot the rod 28 about its longitudinal axis so as to swing the presser portion 33 in a clockwise direction, as seen in FIG. 2, toward the lower edge portion 19 of door 13, thereby urging the door from the closed position of FIG. 1.

In the embodiment of FIGS. 1–4, lower edge portion 19 of the door 13 is provided with a slide plate 40 adapted to be engaged by the bight 41 of presser portion 33 when the presser portion is swung in the clockwise direction illustrated in FIG. 2, to effect opening of the door. As best seen in FIG. 3, slide plate 40 defines a central, vertically elongate slide surface 42 and a pair of slide flanges 43. The slide plate is secured to the lower edge portion 19 of door 13 by suitable means, such as screws 44, extended through the side flanges 43, as illustrated in FIG. 3.

The invention comprehends that the brackets 22 and 23 be mounted to the cabinet 11 and the slide plate 40 mounted to the door prior to shipment of the cabinet structure to the user. The user then may simply install the pivot rod 28 on the brackets 22 and 23 by inserting the end 27 into the opening 26 of bracket 22 and snapfitting the portion 30 of the pivot rod into the pivot flanges 31 of bracket 23, with the spring end 35 disposed subjacent the bottom wall surface 20. Spring 34 then biases the pivot rod in a counterclockwise direction, as seen in FIG. 2, to urge the presser portion 33 toward the bottom wall surface 18, thereby permitting the door 13 to be closed in the normal manner.

However, when the user presses downwardly on the foot pedal portion 37 of the pivot rod against the biasing action of spring 34, bight 41 of the presser portion 33 of the pivot rod bears against the slide surface 42 of the slide plate 40 on the door lower edge portion, and as it moves forwardly away from bottom wall surface 18, urges the door about hinges 15 and 16 away from the closed position. The door may be provided with a conventional magnetic sealing gasket 46. By locating the presser portion 33 remotely from the pivot axis of the door defined by the hinges 15 and 16, the presser portion 33 effects a peeling of the door gasket from the closed position so as to facilitate a door reopening operation, such as where the door is reopened before the vacuum condition, which normally occurs in the refrigeration space upon closing the door, abates.

In a modified form of the door opener, as illustrated in FIG. 5, a roller 45 is mounted to the bight 41 of the presser portion 33 of the pivot rod. The roller is preferably formed of a relatively soft material, such as synthetic resin, rubber, etc., so as to provide a nondamaging engagement of the presser means with the lower edge portion 19 of the door without the need for the installation of the slide plate 40.

In the illustrated embodiment, the pivot rod 28 is formed of chromium-plated steel. The brackets 22 and 23 are formed of molded synthetic resin. The retaining bosses 32 comprises spherical balls welded to the steel rod. Cap 38 is formed of molded synthetic resin.

The door opener structure of the present invention is extremely simple and economical of construction and may be readily mounted to the cabinet structure at the use site by the user without the need for tools, as the brackets 22 and 23 may be previously mounted to the cabinet for receiving the pivot rod by the above discussed simple mounting steps. Where the slide plate is used, it also may be mounted to the door prior to delivery of the cabinet structure to the use site.

The foregoing disclosure of specific embodiments is illustrative of the broad inventive concepts comprehended by the invention.

I claim:

1. In a cabinet structure having wall means defining a front opening cavity defining opposite sides, and a door swingably mounted to the wall means at one side of the cavity for selectively closing said cavity, said wall means having a bottom wall defining a front edge portion and said door defining a lower edge portion juxtaposed to said bottom wall in a closed position of the door extending across the cavity, the improvement comprising a foot operable door opener mounted to the wall means at said bottom wall and at a second side of the cavity opposite said one side, said door opener comprising:

a pivot rod defining a longitudinal axis and having a first end, a laterally projecting presser portion, an opposite, laterally projecting second end portion, and laterally projecting retaining means at a position intermediate said end portions, wherein said retaining means comprises a pair of raised projections spaced apart longitudinally on said pivot rod;

a first pivot bracket mounted to said wall means and defining a socket rotatively receiving said first end of the pivot rod for rotation of the pivot rod about its longitudinal axis;

a second pivot bracket mounted to said wall means and defining a flange for pivotally supporting a portion of the pivot rod inserted laterally thereinto;

means on said wall means for cooperating with said retaining means of the pivot rod for retaining the pivot rod with said first end pivotally associated with said first pivot bracket and said opposite end portion outwardly of said wall means at said second side of the cavity, said presser portion being disposed inwardly of said lower edge portion of the door and swingable outwardly thereagainst as an incident of displacement of said opposite end portion of the pivot rod about said longitudinal axis of the pivot rod, thereby to swing said door outwardly away from said closed position; and means for biasing said pivot rod to urge said presser portion inwardly away from said door.

2. The cabinet structure of claim 1 wherein said raised projections are disposed one each at opposite sides of said means on said wall means for cooperating with said retaining means.

3. The cabinet structure of claim 1 wherein said raised projections are disposed at opposite sides of said second pivot bracket, said opposite sides of said second pivot bracket defining said means on said wall means for cooperating with said retaining means.

4. In a cabinet structure having wall means defining a front opening cavity defining opposite sides, and a door swingably mounted to the wall means at one side of the cavity for selectively closing said cavity, said wall means having a bottom wall defining a bottom surface and further defining a front edge portion and said door defining a lower edge portion juxtaposed to said bottom wall in a closed position of the door extending across the cavity, the improvement comprising a foot operable door opener mounted to the wall means at said bottom wall and at a second side of the cavity opposite said one side, said door opener comprising:

a pivot rod defining a longitudinal axis and having a first end, a laterally projecting presser portion, an opposite, laterally projecting second end portion, and laterally projecting retaining means at a position intermediate said end portions;

a first pivot bracket mounted to said bottom surface of the bottom wall and defining a socket rotatively receiving said first end of the pivot rod for rotation of the pivot rod about its longitudinal axis;

a second pivot bracket mounted to said wall means and defining a flange for pivotally supporting a portion of the pivot rod inserted laterally thereinto;

means on said wall means for cooperating with said retaining means of the pivot rod for retaining the pivot rod with said first end pivotally associated with said first pivot bracket and said opposite end portion outwardly of said wall means at said second side of the cavity, said presser portion being disposed inwardly of said lower edge portion of the door and swingable outwardly thereagainst as an incident of displacement of said opposite end portion of the pivot rod about said longitudinal axis of the pivot rod, thereby to swing said door outwardly away from said closed position; and means for biasing said pivot rod to urge said presser portion inwardly away from said door.

5. The cabinet structure of claim 4 wherein a cap is removably mounted to said opposite end portion for engagement by a user's foot to effect pivoting of the pivot rod about said longitudinal axis thereof to effect said swinging of the door from said closed position by said presser portion of the pivot rod.

6. The cabinet structure of claim 4 wherein said biasing means comprises spring means acting between said wall means and said presser portion of the pivot rod.

7. The cabinet structure of claim 4 wherein said bottom wall of the wall means defines a front surface and said second pivot bracket is mounted to said front surface of the bottom wall.

8. The cabinet structure of claim 4 wherein said presser portion of the pivot rod comprises a U-shaped portion thereof.

9. In a cabinet structure having wall means defining a front opening cavity defining opposite sides, and a door swingably mounted to the wall means at one side of the cavity for selectively closing said cavity, said wall means having a bottom wall defining a front edge portion and said door defining a lower edge portion juxtaposed to said bottom wall in a closed position of the door extending across the cavity, the improvement comprising a foot operable door opener mounted to the wall means at said bottom wall and at a second side of the cavity opposite said one side, said door opener comprising:

a pivot rod defining a longitudinal axis and having a first end, a laterally projecting presser portion, an opposite, laterally projecting second end portion comprising a U-shaped portion thereof, and laterally projecting retaining means at a position intermediate said end portions;

a first pivot bracket mounted to said wall means and defining a socket rotatively receiving said first end of the pivot rod for rotation of the pivot rod about its longitudinal axis;

a second pivot bracket mounted to said wall means and defining a flange for pivotally supporting a portion of the pivot rod inserted laterally thereinto;

means on said wall means for cooperating with said retaining means of the pivot rod for retaining the pivot rod with said first end pivotally associated with said first pivot bracket and said opposite end portion outwardly of said wall means at said second side of the cavity, said presser portion being disposed inwardly of said lower edge portion of the door and swingable outwardly thereagainst as an incident of displacement of said opposite end portion of the pivot rod about said longitudinal axis of the pivot rod, thereby to swing said door outwardly away from said closed position; and means for biasing said pivot rod to urge said presser portion inwardly away from said door.

10. The cabinet structure of claim 4 further including a roller mounted to said presser portion to have rolling engagement with said door lower edge portion.

11. The method of mounting a foot pedal-operated door opener to a cabinet structure comprising the steps of:

providing a cabinet structure having wall means defining a front opening cavity defining opposite sides, and a door swingably mounted to the wall means at one side of the cavity for selectively closing said cavity, said wall means having a bottom wall defining a front edge portion and said door defining a lower edge portion juxtaposed to said bottom wall in a closed position of the door extending across the cavity;

mounting a first pivot bracket to said wall means;

mounting a second pivot bracket to said wall means;

causing said cabinet construction to be transported to a use site with said pivot brackets so mounted; installing a pivot rod in association with said pivot brackets at said use site, said pivot rod comprising a rod defining a longitudinal axis and having a first end, a laterally projecting presser portion, an opposite, laterally projecting second end portion, and laterally projecting retaining means at a position intermediate said end portions, said first pivot bracket defining a socket releasably, rotatively receiving said first end of the pivot rod for rotation of the pivot rod about its longitudinal axis, said second pivot bracket defining an upturned flange for releasably, pivotally supporting a portion of the pivot rod inserted laterally thereinto, said installing step including the steps of inserting said first end of said rod into said socket and snapfitting said portion of the pivot rod into said upturned flange;

providing means on said wall means for cooperating with said retaining means of the pivot rod for retaining the pivot rod with said first end pivotally associated with said first pivot bracket and said opposite end portion outwardly of said wall means at a second side of the cavity opposite the one side of the cavity, said presser portion being disposed inwardly of said lower edge portion of the door and swingable outwardly thereagainst as an incident of displacement of said opposite end portion of the pivot rod about said longitudinal axis of the pivot rod, thereby to swing said door outwardly away from said closed position; and providing means for biasing said pivot rod to urge said presser portion inwardly away from said door.

12. The method of mounting a foot pedal-operated door opener to a cabinet structure of claim 11 wherein said bottom wall of the wall means defines a front surface and said second pivot bracket is mounted to said front surface of the bottom wall.

13. The method of mounting a foot pedal-operated door opener to a cabinet structure comprising the steps of:

providing a cabinet structure having wall means defining a front opening cavity defining opposite sides, and a door swingably mounted to the wall means at one side of the cavity for selectively closing said cavity, said wall means having a bottom wall defining a front edge portion wherein said bottom wall of said wall means defines a bottom surface and said door defining a lower edge portion juxtaposed to said bottom wall in a closed position of the door extending across the cavity;

mounting a first pivot bracket to said wall means, wherein said first pivot bracket is mounted to said bottom surface of the bottom wall;

mounting a second pivot bracket to said wall means;

causing said cabinet construction to be transported to a use site with said pivot brackets so mounted; installing a pivot rod in association with said pivot brackets at said use site, said pivot rod comprising a rod defining a longitudinal axis and having a first end, a laterally projecting presser portion, an opposite, laterally projecting second end portion, and laterally projecting retaining means at a position intermediate said end portions, said first pivot bracket defining a socket rotatively receiving said first end of the pivot rod for rotation of the pivot rod about its longitudinal axis, said second pivot bracket defining a flange for pivotally supporting a portion of the pivot rod inserted laterally thereinto;

providing means on said wall means for cooperating with said retaining means of the pivot rod for retaining the pivot rod with said first end pivotally associated with said first pivot bracket and said opposite end portion outwardly of said wall means at a second side of the cavity opposite to one side of the cavity, said presser portion being disposed inwardly of said lower edge portion of the door and swingable outwardly thereagainst as an incident of displacement of said opposite end portion of the pivot rod about said longitudinal axis of the pivot rod, thereby to swing said door outwardly away from said closed position; and providing means for biasing said pivot rod to urge said presser portion inwardly away from said door.

14. In a cabinet structure having wall means defining a front opening cavity defining opposite sides, and a door swingably mounted to the wall means at one side of the cavity for selectively closing said cavity, said wall means having a bottom wall defining a front edge portion and said door defining a lower edge portion juxtaposed to said bottom wall in a closed position of the door extending across the cavity, the improvement comprising a foot operable door opener mounted to the wall means at said bottom wall and at a second side of the cavity opposite said one side, said door opener comprising:

a pivot rod defining a longitudinal axis and having a first end, a laterally projecting presser portion, an opposite, laterally projecting second end portion, and laterally projecting retaining means at a position intermediate said end portions;

a slide plate on said door lower edge portion;

a first pivot bracket mounted to said wall means and defining a socket releasably, rotatively receiving said first end of the pivot rod for rotation of the pivot rod about its longitudinal axis;

a second pivot bracket mounted to said wall means and defining an upturned flange providing a releasable snapfit retention for pivotally supporting a portion of the pivot rod inserted laterally thereinto;

means on said wall means for cooperating with said retaining means of the pivot rod for retaining the pivot rod with said first end pivotally associated with said first pivot bracket and said opposite end portion outwardly of said wall means at said second side of the cavity, said presser portion being disposed inwardly of said lower edge portion of the door and swingable outwardly against said side plate as an incident of displacement of said opposite end portion of the pivot rod about said longitudinal axis of the pivot rod, thereby to swing said door outwardly away from said closed position; and means for biasing said pivot rod to urge said presser portion inwardly away from said door.

15. The cabinet structure of claim 14 wherein said slide plate defines a vertically elongate slide surface engaged by said presser portion.

16. The cabinet structure of claim 14 wherein said slide plate is formed of a synthetic resin.

17. The cabinet structure of claim 14 wherein said slide plate is formed of a synthetic resin having a low surface friction characteristic.

18. In a cabinet structure having wall means defining a front opening cavity defining opposite sides, and a door swingably mounted to the wall means at one side of the cavity for selectively closing said cavity, said wall means having a bottom wall defining a front edge portion and said door defining a lower edge portion juxtaposed to said bottom wall in a closed position of the door extending across the cavity, the improvement comprising a foot operable door opener mounted to the wall means at said bottom wall and at a second side of the cavity opposite said one side, said door opener comprising:

a pivot rod defining a longitudinal axis and having a first end, a laterally projecting presser portion, an opposite, laterally projecting second end portion, and laterally projecting retaining means at a position intermediate said end portions;

a slide plate on said door lower edge portion, said slide plate defining a vertically elongate slide surface engaged by said presser portion and side flanges, and means are provided for removably securing said side flanges to said door lower edge portion;

a first pivot bracket mounted to said wall means and defining a socket rotatively receiving said first end of the pivot rod for rotation of the pivot rod about its longitudinal axis;

a second pivot bracket mounted to said wall means and defining a flange for pivotally supporting a portion of the pivot rod inserted laterally thereinto;

means on said wall means for cooperating with said retaining means of the pivot rod for retaining the pivot rod with said first end pivotally associated with said first pivot bracket and said opposite end portion outwardly of said wall means at said second side of the cavity, said presser portion being disposed inwardly of said lower edge portion of the door and swingable outwardly against said side plate as an incident of displacement of said opposite end portion of the pivot rod about said longitudinal axis of the pivot rod, thereby to swing said door outwardly away from said closed position; and means for biasing said pivot rod to urge said presser portion inwardly away from said door.

* * * * *